US006948489B1

(12) United States Patent
O'Neal

(10) Patent No.: US 6,948,489 B1
(45) **Date of Patent: *Sep. 27, 2005**

(54) STONE CUTTER

(76) Inventor: Roy G. O'Neal, 1715 Woodley Rd., Mobile, AL (US) 36618

( * ) Notice: Subject to any disclaimer, the term of this patent is extended or adjusted under 35 U.S.C. 154(b) by 0 days.

This patent is subject to a terminal disclaimer.

(21) Appl. No.: 10/779,889

(22) Filed: Feb. 17, 2004

Related U.S. Application Data

(63) Continuation-in-part of application No. 09/849,095, filed on May 4, 2001.

(60) Provisional application No. 60/202,498, filed on May 5, 2000.

(51) Int. Cl.[7] ..... B28D 1/32

(52) U.S. Cl. ..... 125/23.01; 125/35; 125/36; 125/40

(58) Field of Search ..... 125/23.01, 35, 125/36, 40

(56) References Cited

U.S. PATENT DOCUMENTS

| | | | | |
|---|---|---|---|---|
| 4,192,364 | A | 3/1980 | Findley | |
| 5,152,275 | A * | 10/1992 | Landhuis | 125/12 |
| 5,289,816 | A | 3/1994 | Rakowski | |
| 5,690,348 | A * | 11/1997 | Williams, Jr. | 280/477 |
| 6,076,576 | A * | 6/2000 | Maddox et al. | 144/195.1 |
| 6,240,913 | B1 | 6/2001 | Snell | |

* cited by examiner

*Primary Examiner*—Joseph J. Hail, III
*Assistant Examiner*—Shantese McDonald
(74) *Attorney, Agent, or Firm*—George L. Williamson

(57) ABSTRACT

A rock cutter for splitting stones is disclosed which shows a support surface for holding the rock and a first blade and a second blade which may be positioned to hold the rock between the first and second blades and on the support surface along with a means for moving the first blade towards the second blade. The means for moving comprises a hydraulically driven piston having a piston arm to which the first blade is mounted. The rock cutter also has a cover which is used in conjunction with a means for receiving pieces of the rock after the rock is split.

12 Claims, 2 Drawing Sheets

STONE CUTTER

PRIOR APPLICATIONS

This application is a continuation-in-part of U.S. application Ser. No. 09/849,095 filed on May 4, 2001 which claimed benefit of U.S. Provisional Patent: 60/202,498 filed May 5, 2000.

BACKGROUND OF THE INVENTION

1. Field of Invention

The present invention generally relates to stone cutting and more particularly it is a stone cutter using a hydraulically driven wedge in order break stones.

2. Prior Art

In the art of stone cutting most stones are cut by hand and it is a long and tedious process. It involves the use of laborious techniques with hand held metal tools, table mounted saws and scoring devices.

While these stone cutters may be suitable for the purposes for which they were designed, they would not be as suitable for the purposes of the present invention, as hereinafter described.

The invention discloses a stone splitter which utilizes a hydraulic arm ending in a point or wedge in order to split stones. The hydraulic arm has a point on one end and the opposite end fits within a hydraulic cylinder which forces the wedge into the stone. A fixed wedge opposite the wedge on the hydraulic arm is provided.

A power supply provides for hydraulic fluid under pressure as with an electric pump or gas pump.

In order to get an adequate result, the hydraulic arm operates within the tolerances of speed and force so as to properly cut the stone. The hardness of the cutting (59–60 being best) blade is between 46 and 67 on the Rockwell scale.

The force is sufficient to break the stone. Another object of the present invention is to operate more slowly in order to not shatter the stones requiring a steady break.

As a result of difficulty in making cuts and damage caused by misalignment and bad strike angles there is a great deal of waste not only of time but also of material in the prior art. Various devices have been developed in order to try to aid stone cutters but none of those have effectively allowed for the cutting of raw stone.

An object of the invention is to provide a stone cutter which can be easily used and which is very mobile which can be utilized in order to cut stone or brick of various types and having irregular shapes.

The foregoing and other objects and advantages will appear from the description to follow. In the description, reference is made to the accompanying drawings, which form a part hereof and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention.

The following detailed description is, therefore, not to be taken in a limiting sense, and the scope of the present invention is best defined by the appended claims.

BRIEF DESCRIPTION OF DRAWINGS

In order that the invention may be more fully understood, it will now be described, by way of example, with reference to the accompanying drawings in which.

DETAILED DESCRIPTION OF THE PREFERRED EMBODIMENTS

Figure 1:
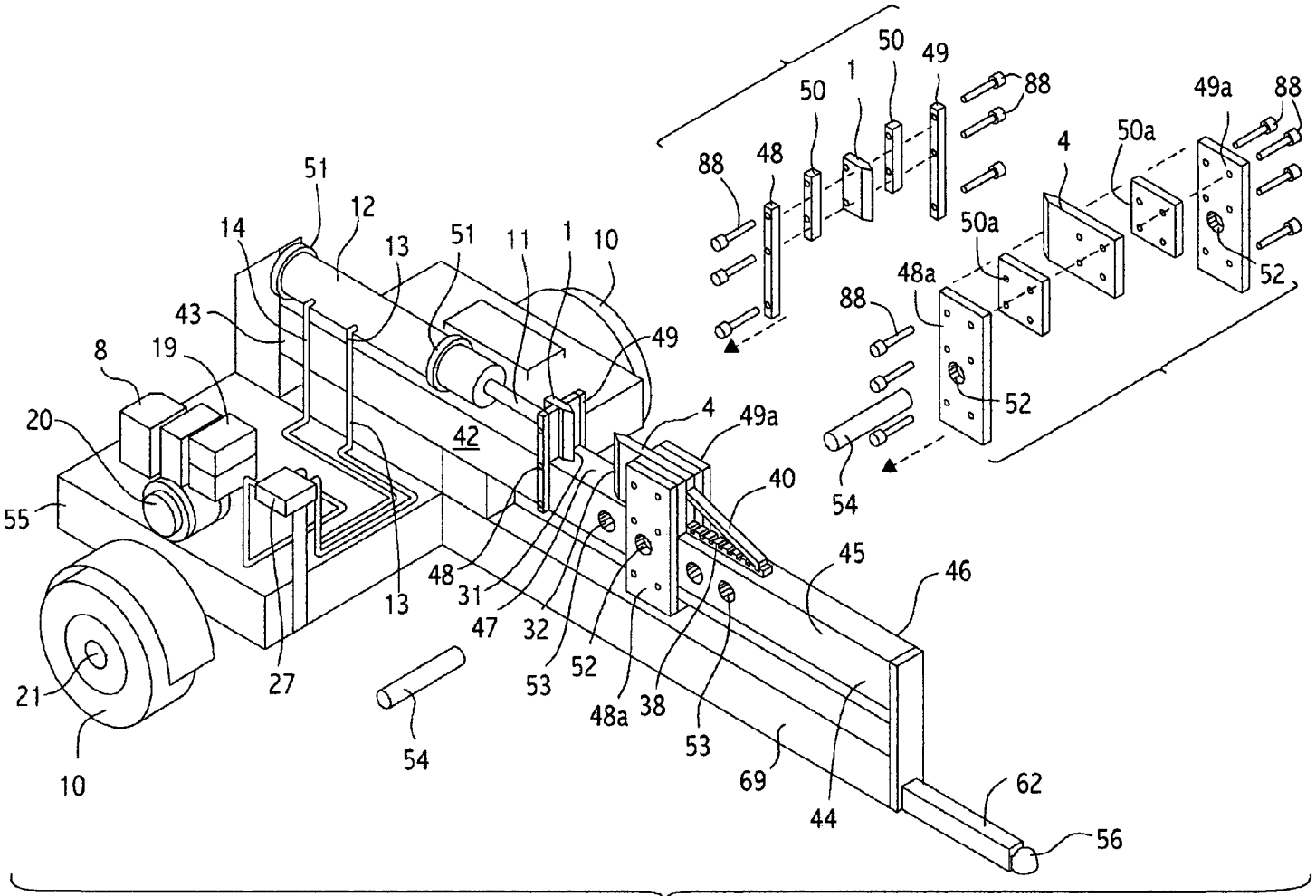
FIG. 1 is a perspective view of the preferred embodiment of the cutter.

Turning now descriptively to the drawings, in which similar reference characters denote similar elements throughout the several views wherein the figures illustrate the present invention wherein a stone cutter is disclosed.

Referring to FIG. 1, the rock cutter for splitting stones has a support means, e.g., iron bar 42, having a first end 43, a second end 44, a left side 45 and a right side 46 and a support length between the first end and the second end and a support surface 47 along the support length for supporting a rock (not shown) to be cut.

The first blade holding means is defined by a support arm 48 slidably contacting the left side and a support arm 49 slidably contacting the right side of the iron bar 42 so that the position of the movable first blade 1, held centered by centering spacers 50, is supported slightly above (by the spacers 50) and on either side away from (by the support arms 48 and 49) the iron bar 42 as the blade 1 moves along the support length. If necessary, the bottom of the two support arms 48, 49 may be attached for added support. The hydraulic cylinder 12 is also supported by two rings 51 so that the piston is also adequately supported.

The first blade 1 has a sharpened edge 31 with a first blade edge length so that it forms a wedge which is driven by the piston into the rock to be split.

The movably fixed second blade 4 is similarly designed. It is attached to a second blade holding means for holding a blade in a fixed position on the support means along the support length which is similar to the means holding the first blade having a support arm 48*a* slidably contacting the left side and a support arm 49*a* slidably contacting the right side of the iron bar 42 so that the position of the second blade 4, held centered by centering spacers 50*a* is supported slightly above (by the spacers 50*a*) and on either side (by the support arms 48*a* and 49*a*) away from the iron bar 42 as the blade is moved to a fixed location along the support length.

The method of fixing the blades 1,4 to the spacers and support arms is by way of using a conventional nut and bolt fastener 88 or the like for fastening these parts together so that a very stiff arrangement of the blades is accomplished so that the edges of the blades are in the same plane. The second blade 4 has a sharpened edge 32 and a second blade edge length which is preferably the same as the first blade length to provide for better splitting along a similar fault line.

The cutter blade support means 48,49 supports the first blade so that the first blade 1 edge length is approximately perpendicular to the support surface 47.

In the preferred embodiment, the first blade holding means comprises a hydraulically driven piston having a hydraulic cylinder 12 and a piston arm 11 with a blade holding means for holding the first blade so that it is approximately perpendicular to the support surface 47.

The second blade holding means comprises a support arm 48*a* slidably contacting the left side of the support surface 47 and a support arm 49*a* slidably contacting the right side of the support surface 47 so that the position of the second blade 4 is supported where held along the support length which is the area of the support surface 47 between the two blades.

The second blade holding means further comprises a fixing means for holding the second blade at a fixed position along the support length. In the preferred embodiment, the fixing means comprises at least one opening 52 defined by each of the support arms 48*a* and 49*a* contacting the left side and right side of the support beam 42 and a plurality of corresponding openings 53 defined along the left side and passing through to the right side of the support beam 42 and a securing means, e.g., a bolt 54 or the like, fitting through the support arm openings or holes 52 and at least one of the plurality of beam openings or holes 53.

An alternative method of fixing the position of the second blade 4 would be a brake 40 mechanism having a member with a first end and a second end with the first end attached to the rear of second blade 4, a plurality of notches 38 defined along the support surface wherein the second end of the brake is insertable into at least one of the plurality of notches 38. Under either embodiment or the equivalent thereof, the purpose is to allow the support surface length to be adjusted in accordance with the rock to be split without requiring piston arm 11 to have a gerater length so that the hydraulic arm 11 may move, but still be relatively fixed in position, relative to the cutting edge of the second blade 4. To this end, the piston cylinder 12 is fixed in position by two heavy rings 51 which are tightly welded or bolted to the support beam 42 so that the alignment and movement of the piston stays consistent through use to drive the first blade edge and second blade edge together along a common plane. This brake 40 may be incrementally adjustable by having a ring bolt as part of the brake so that the length of the brake is adjustable incrementally. This is usually made less necessary since the piston arm position can also be adjusted incrementally.

In order to allow the user to move away from the stone as it is cut, there may be a catching means located along the length of the support means and below the support surface for receiving pieces falling from the support surface. In the preferred embodiment, the catching means comprises an angled plate 26 (See FIG. 2) rising on either side of the support surface from below the support surface to form a catch basin so that split rocks fall onto the angled sides.

A beam 69 adds support below the support surface 42.

By using a catch basin, a shield or cover 39 (See FIG. 2) means located on the first end and fold-able above the support length is possible so that a rock supported on the support surface may be covered to prevent chips of rock from exiting the work area.

To make the device transportable, it also comprises a supporting frame 55 attached below the support beam for supporting the motor 20 and controls 27 and pump 19 for supplying hydraulic fluid to the hydraulic cylinder 12. To add mobility to the device, it also comprises an axle 21 rotatably connected below the supporting frame 55 and wheels 10 attached to either end of the axle 21. Also shown are hydraulic fluid reservoir 8, hydraulic fluid return or outlet conduit 13 and fluid inlet conduit 14.

When the device is to be hauled, only a single axle is necessary (it may be driven by its own motor with two sets of wheels or a three wheel arrangement). When hauled, it has a trailer hitch 56 attached on the second end 44 of the support beam 42 so that the rock splitter may be attached to a corresponding trailer hitch on the rear of a vehicle for towing the unit. In the preferred embodiment, the hitch 56 comprises an attachment means for holding the vehicle, such as a socket, of a ball and socket arrangement attached to a horizontal arm or tongue 62.

The rock cutting process follows the process steps wherein:

a) The blades are separated by a distance adequate to allow the stone to be put into place with the stone marked on either side where the cut it to be made as with a chalk line;

b) The blades are then slowly adjusted so that they come together on either side where the cut is to be made;

c) Thereafter the user moves back so that potential flying rock or debris does not hurt the user and then activates the slow expansion of the piston rod; and, d) Once the stone breaks into two pieces cut thereby and falls into the catch basin the user can remove them for use or reposition them for further cuts.

There is a trailer hitch 56 so that the device may be towed like a trailer and there is at least one foot or jack stand 64 which travels downward to the ground. The stand 64 may have a stand extension 65 which adjustably extends downwardly to allow for the leveling of the device when operated on uneven ground.

When the device is used the stone to be cut is put in place between the two blades 1 and 4. Each of these wedge shaped blades has a blade that is sufficiently sharp in order to make a proper cut on the stone in question.

The valves controlling the piston for pushing the piston arm 11 forward and into the stone are then pressurized. The appropriate pressure may be variable and the speed of the fluid flow may be variable to accommodate different stones.

As can be seen, the cutting surface may be elevated. The purpose for this elevation is to make it easier to work on the cutting surface. Alternatively you could have a device which would have a variable height so that stone could be cut at different levels.

The blades 1 and 4 are preferably made out of tool steel and have a point which is between 1/32" and 1/8" in width or thickness. A sharper width of the blade is possible but in most cases not desirable since it would result in undue wear and tear on the blades. It is possible that one of the blades may be less sharp and still obtain the appropriate cutting features. The vertical length of the blade up and down is such that it is preferably at least as long as most pieces of rock which will be cut.

It is believed to be necessary that the two blades be on either side of the cut in order that the matrix of the stone be split evenly.

Figure 2:
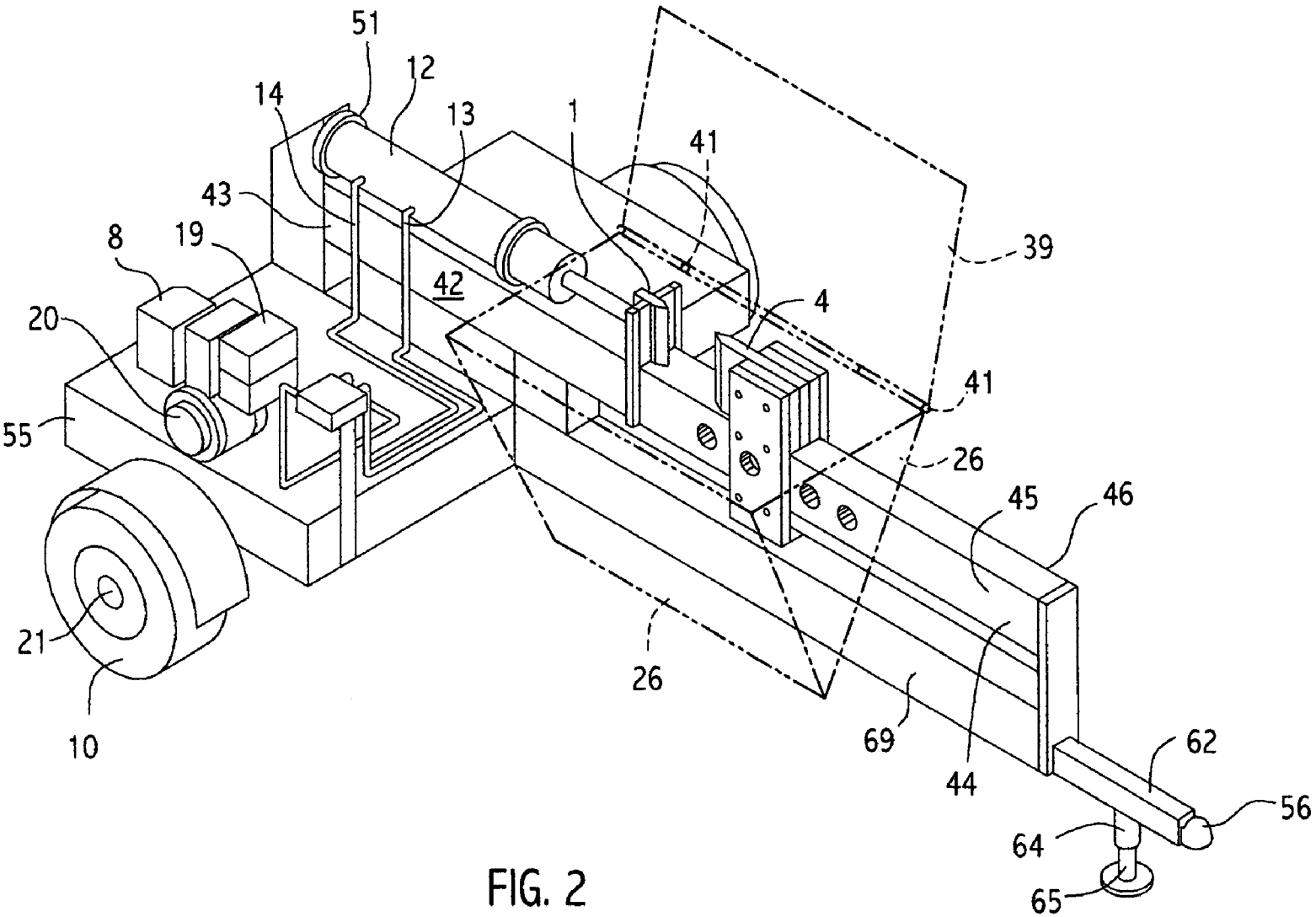
FIG. 2 is a perspective view of an alternate embodiment of the cutter.

As shown in FIG. 2, the invention also comprises a V-shaped rock catching member, angled plate 26, on either side of the stone. This particular angled plate 26 would be larger than the width of a typical stone which would be cut utilizing this invention and would have the primary purpose, not of holding the stone, but of catching the two pieces that are cut after the cut takes place. It could also be used to hold the stone lightly, although it is felt that this would not work as well. Also shown is a shield 39 on hinges 41 which can be attached as a cover at the top of one of angled plates 26 to prevent rock splinters from injuring the user.

Any stone holding mechanism preferably would not compress the stones, since that might result in an uneven cut, but would instead hold it loosely in place.

The hydraulics are slow speed hydraulics since high speed hydraulics would tend to shatter the stone and a slow steady pressure on blades of the type described herein yields a good cut. A control 27 is provided to drive the piston.

As can best be seen by reference to FIG. 1, the invention comprises a moving blade 1 which is aligned with a still blade 4 utilizing outside aligning holes 52,53. There are two blades 1 and 4 which are removably attached to the blade mountings in order to allow it to be replaced or sharpened.

An electric or gas motor 20 powers a two stage pump 19 which supplies hydraulic fluid from reservoir 8 under pressure to a hydraulic valve controlled by the control 27. The hydraulic valve provides fluid power to a hydraulic cylinder 12 which drives a piston arm 11 in the conventional manner.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. A rock cutter for splitting stones, comprising:

(a) a support means having a first end, a second end, a left side and a right side and a support length between the first end and the second end aid a support surface along the support length for supporting a rock to be cut;

(b) a first blade holding means attached to the support means for holding a blade and extending the blade along the support length;

(c) a first blade having a sharpened edge with a first blade edge length attached to the first blade holding means;

(d) a second blade holding means for holding a blade in a fixed position on the support means along the support length;

(e) a second blade having a sharpened edge and a second blade edge length and wherein the first blade holding means comprises a hydraulically driven piston having a hydraulic cylinder and a piston arm with a blade holding means for holding the first blade so that it is approximately perpendicular to the support surface; and, (f) wherein the first blade holding means further comprises a support arm slidably contacting the left side and a support arm slidably contacting the right side so that the position of the first blade is supported as the blade moves along the support length.

2. The rock cutter of claim 1, wherein the second blade holding means comprises a support arm slidably contacting the left side and a support arm slidably contacting the right side so that the position of the second blade is supported where held along the support length.

3. The rock cutter of claim 2, wherein the second blade holding means further comprises a fixing means for holding the second blade at a fixed position along the support length.

4. The rock cutter of claim 3, wherein the fixing means further comprises an opening defined by the support arm contacting the left side adjacent to the left side, a plurality of corresponding openings defined by the left side and a securing means fitting through the support arm opening and at least one of the plurality of left side openings.

5. The rock cutter of claim 4, wherein the fixing means further comprises an opening defined by the support arm contacting the right side adjacent to the right side, a plurality of corresponding openings defined by the right side and a securing means fitting through the support arm opening and at least one of the plurality of right side openings.

6. The rock cutter of claim 3, wherein the fixing means further comprises a brake having a first end and a second end with the first end attached to the second blade, a plurality of openings defined along the support surface and wherein the second end of the brake is insertable into at least one of the plurality of openings.

7. The rock cutter of claim 1, further comprising a supporting plate attached to the support means for supporting a motor for supplying hydraulic fluid to the hydraulic cylinder.

8. The rock cutter of claim 7, further comprising an axle rotatably connected to the supporting plate below the support means and a plurality of wheels attached to the axle and wherein the rock cutter further comprises a trailer hitch attached to the supporting plate so that the rock splitter nay be attached to a trailer hitch for movement.

9. The rock cutter of claim 8, wherein said trailer hitch further comprises a jack stand being disposed adjacent said trailer hitch to permit the rock cutter to be leveled when operated on uneven ground.

10. A rock cutter for splitting stones, comprising:

(a) a support means having a first end, a second end, a left side and a right side and a support length between the first end and the second end and a support surface along the support length for supporting a tuck to be cut;

(b) a first blade holding means attached to the support means for holding a blade and extending the blade along the support length;

(c) a first blade having a sharpened edge with a first blade edge length attached to the first blade holding means;

(d) a second blade holding means for holding a blade in a fixed position on the support means along the support length; and (e) a second blade having a sharpened edge and a second blade edge length and further comprising a catching means located along the length of the support means and below the support surface for receiving pieces falling from the support surface.

11. The rock cutter of claim 10, wherein the catching means comprises an angled plate rising on either side of the support surface from below the support surface so that rocks split fall onto the angled sides.

12. A rock cutter for splitting stones comprising:

(a) a support means having a first end, a second end, a left side and a right side and a support length between the first end and the second end and a support surface along the support length for supporting a rock to be cut;

(b) a first blade holding means attached to the support means for holding a blade and extending the blade along the support length;

(c) a first blade having a sharpened edge with a first blade edge length attached to the first blade holding means;

(d) a second blade holding means for holding a blade in a fixed position on the support means along the support length; and, (e) a second blade having a sharpened edge and a second blade edge length and further comprising a shield means located on the first end and foldable above the support length so that a rock supported on the support surface may be covered to prevent chips of rock from exiting the work area.

* * * * *